US005096443A

United States Patent [19]

Myrick et al.

[11] Patent Number: 5,096,443

[45] Date of Patent: Mar. 17, 1992

[54] KEYED APPARATUS FOR PROVIDING GROUND, POWER OR SIGNAL CONNECTIONS

[75] Inventors: Alan T. Myrick, Phoenix; Carl R. Tarver, Chino Valley, both of Ariz.

[73] Assignee: Siemens Aktiengesellschaft, Fed. Rep. of Germany

[21] Appl. No.: 619,786

[22] Filed: Nov. 29, 1990

[51] Int. Cl.[5] ..... H01R 13/64

[52] U.S. Cl. ..... 439/681; 439/680

[58] Field of Search ..... 439/677, 680, 681, 633, 439/677, 101, 62

[56] References Cited

U.S. PATENT DOCUMENTS

| | | | |
|---|---|---|---|
| 3,582,867 | 6/1971 | Thompson | 439/677 |
| 4,568,134 | 2/1986 | DiMondi | 439/680 |
| 4,904,194 | 2/1990 | Kilsdonk et al. | 439/681 |
| 4,929,184 | 5/1990 | Emadi et al. | 439/681 |
| 4,934,950 | 6/1990 | Green et al. | 439/681 |

*Primary Examiner*—Larry I. Schwartz
*Assistant Examiner*—Hien D. Vu

[57] ABSTRACT

An arrangement for providing a connection for ground, power or signals for an electronic connector assembly which also provides a keying function.

4 Claims, 3 Drawing Sheets

KEYED APPARATUS FOR PROVIDING GROUND, POWER OR SIGNAL CONNECTIONS

BACKGROUND OF THE INVENTION

There are assemblies in equipment used in the telecommunications industry which connect printed circuit boards to backplanes, or mother boards, and provide ground connection, power connection and signal connection thereto. Generally, the connectors used are two-piece devices which have separate structure for providing the electrical connection function and a keying function, which latter function insures that only the appropriate circuit board is connected to the mother board in the appropriate "slot".

It is therefore an object of this invention to provide a connector assembly having a two-part terminal where the terminal parts are each shaped and orientable in a plurality of positions to provide a keying function in addition to an electrical connection function.

SUMMARY OF THE INVENTION

The foregoing and additional objects are attained in accordance with the principles of this invention by providing a two-part circuit board connector assembly having a two-part terminal. The two-part terminal is provided with a first part having means for securing it to a first part of the connector assembly and a second part having means for securing it to the second part of the connector assembly. The two parts of the terminal are configured so that they can only be coupled together in one orientation relative to each other, thereby providing a keying function.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
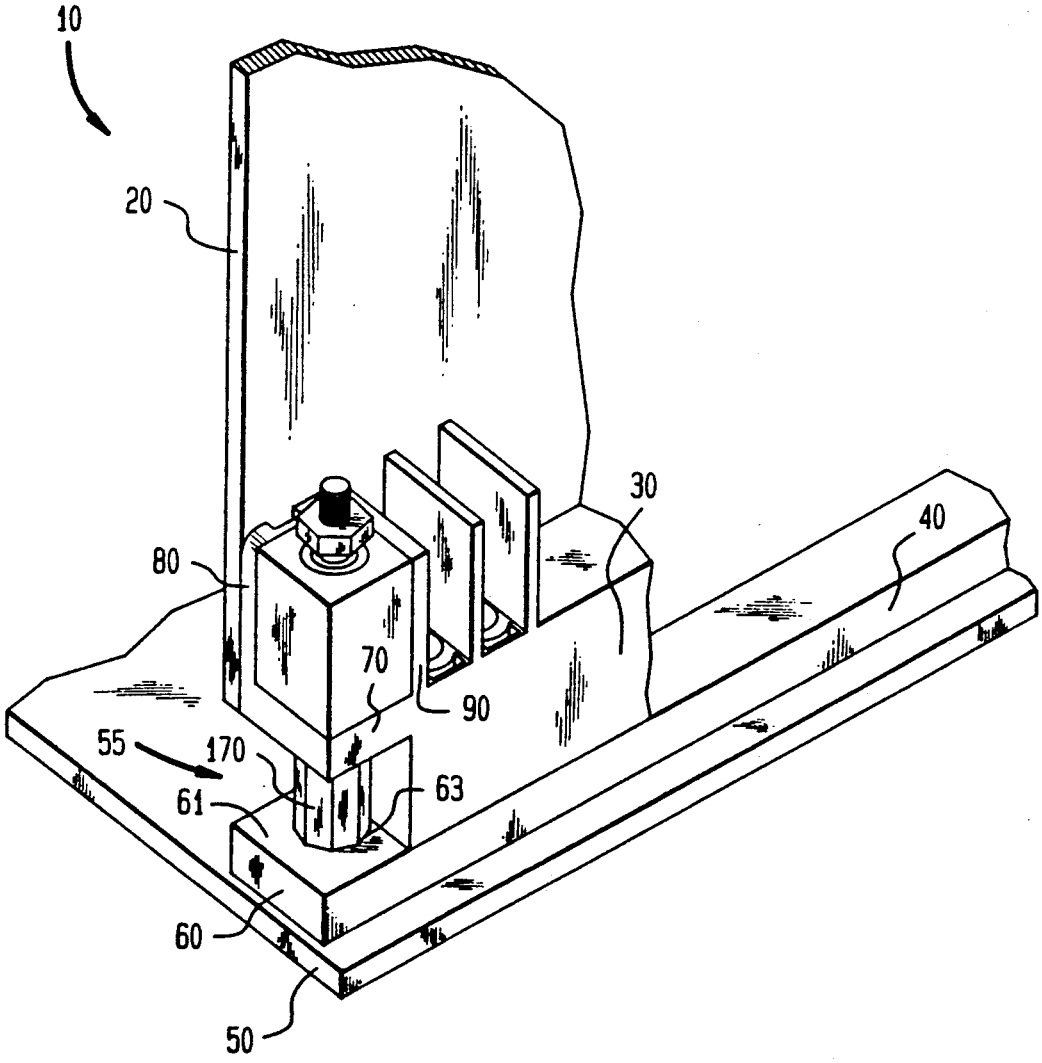
FIG. 1 is a perspective view of an assembly embodying the invention coupled to a printed circuit board.
Figure 2:
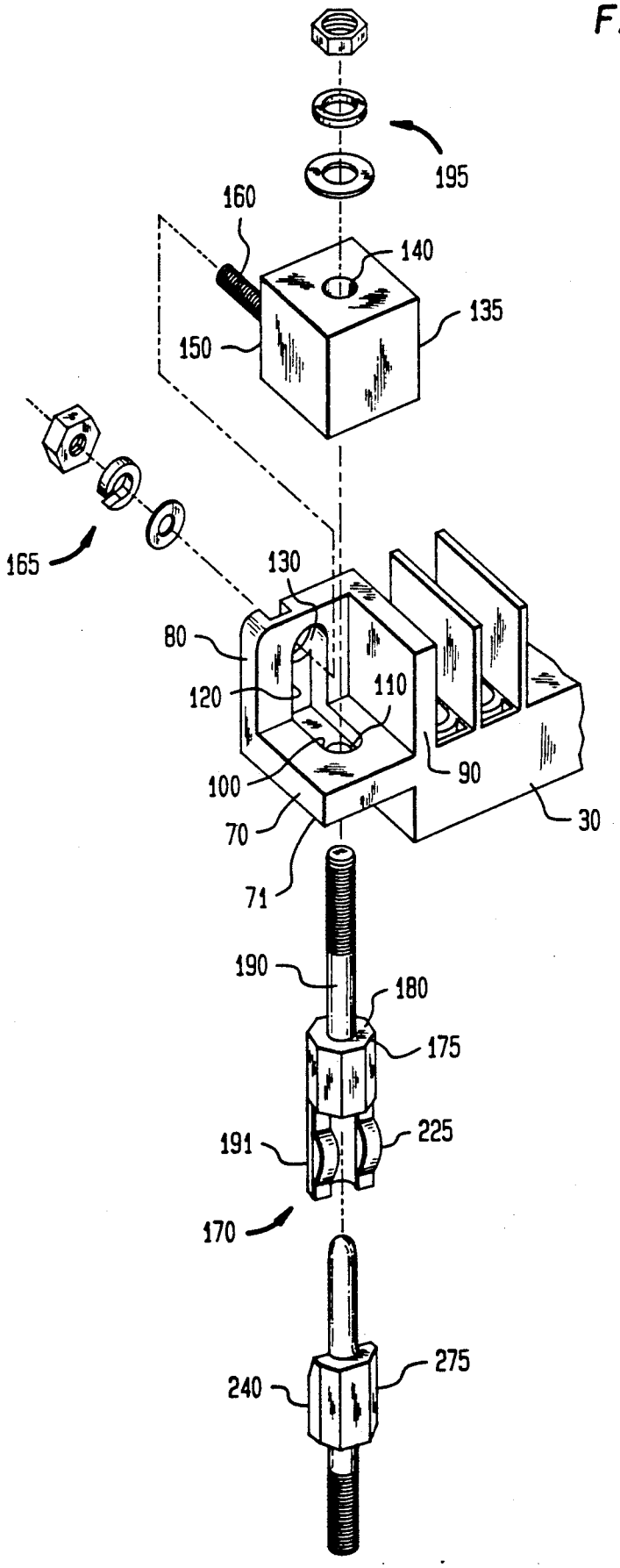
FIG. 2 is an exploded view of the assembly of FIG. 1.

The keyable electrical assembly of the invention, designated generally by the reference numeral 10, is shown in operative relation with a printed circuit board 20 coupled to a circuit board connector 30 which is supported on and secured to a mating backplane connector 40. The mating backplane connector 40 is supported on a backplane, or mother board, 50. The circuit board connector 30 and mating backplane connector 40 are shaped to provide at each end a U-shaped structure 55 including a horizontal base plate portion 60 which is part of backplane connector 40 and an upper horizontal plate portion 70 which is part of the circuit board connector 30 and is parallel to the base plate portion 60. The upper plate 70 forms the base for a two-wall right angle structure which functions for mounting to the printed circuit board and includes a flat rear wall 80 and a flat side wall 90 secured to each other. The upper plate 70 includes a horizontal groove 100 (FIG. 2) which extends into it from the rear wall 80 and terminates in a hole 110. The groove 100 joins a similar vertical groove

120 in the rear wall 80. The groove 120 extends upwardly from the upper plate 70 and terminates in a hole 130.

The assembly 10 includes a spacer block 135 which is shaped to fit into the corner formed by the upper plate 70 and the rear and side walls 80 and 90 and to fit in the space defined by these walls. The block 135 has a central vertical through hole 140 which communicates with the hole 110 in the base plate 70 and it carries on its rear wall 150 a threaded stub 160 which is positioned to extend into the hole 130 in the vertical slot 120 in the rear wall 80. The block 135 is then suitably secured to the rear wall 80 by hardware 165.

The mounting arrangement is such that, in a piece of equipment, the printed circuit board 20 is mounted against the rear surface of the connector body 30 and the vertical wall 80 and is held in place by the hardware 165 coupled to the stub 160.

Figure 3:
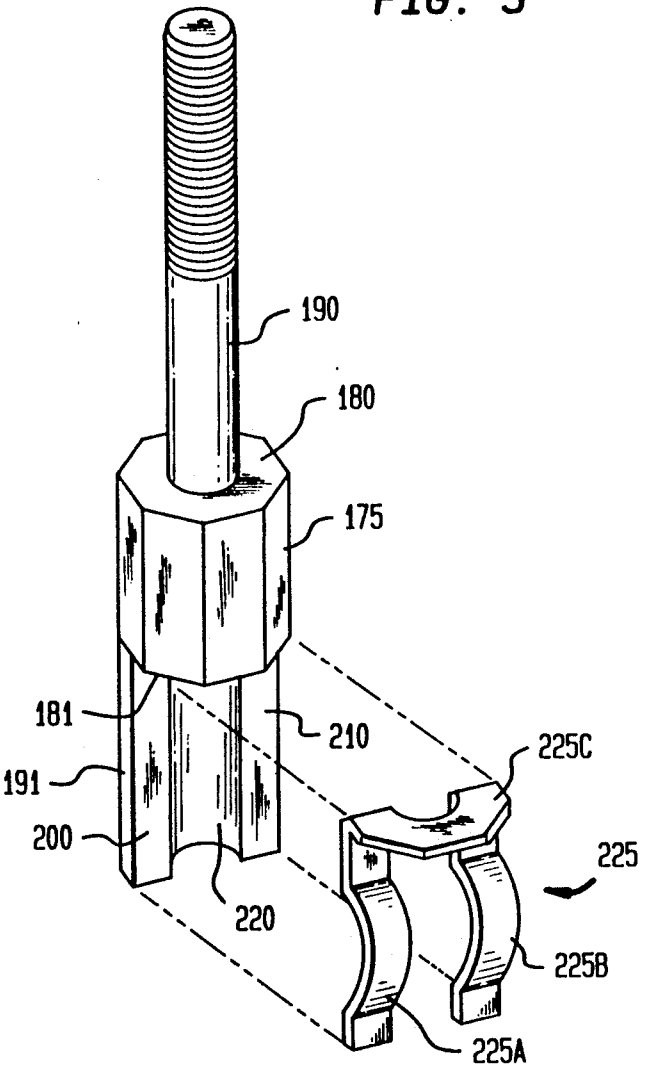
FIG. 3 is an enlarged exploded perspective view of a portion of the assembly of FIG. 1.

The assembly 10 also includes a two-part keyed and guided connector terminal 170 comprising a first octagonal body 175 having a top surface 180 from which a threaded stub 190 vertically extends. When connector part 175 and the right angle connector are assembled, the stub 190 extends through the hole 110 in the upper plate 70 and hole 140 in block 135 and is secured in place by means of suitable hardware 195 secured to its upper end. The lower surface 71 of the upper plate 70 is provided with an octagonal recess (not shown) into which the upper part 180 of element 175 is seated. The main body of the receptacle part 175 is octagonal in shape as part of the keying arrangement of the invention and it includes a lower portion 191 which is formed by half of the octagon body being cut away (FIG. 3) to provide two flat spaced apart surfaces 200 and 210 separated by a semicircular groove 220 at about the center or vertical axis of the part 170 and aligned with the stub 190.

A contact spring 225 is provided which comprises two spaced apart curved arms 225A and 225B extending downwardly from a flat upper connecting portion 225C which bears against and is spot welded to the lower flat wall 181 of the part 175 at the cutaway portion and the two arms 225A and 225B are aligned with the two flat walls 200 and 210 of the lower portion of the receptacle part 175.

Figure 4:
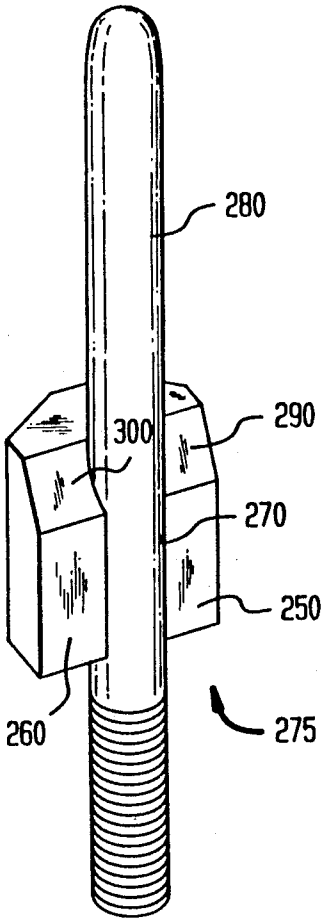
FIG. 4 is an enlarged perspective view of another portion of the assembly of FIG. 1.

The assembly is completed by the second part 275 of the terminal 170. Part 275 is keyed to mate with part 175 and comprises a body which is half of an octagon and includes on its inner surface 240 (FIG. 2) two flat walls 250 and 260 (FIG. 4) which are spaced apart and define a central bore 270 which receives a threaded pin 280. The upper ends of the flat walls 250 and 260 have curved depressions 290 and 300 which are shaped to mate with the upper portions of the spring contact arms 225A and 225B.

Part 275 is secured to part 175 with the upper end of pin 280 in the central bore which is a continuation of the groove 220 in the body of part 175 and with the walls 250 and 260 bearing against walls 200 and 210 with the contact spring 225 between them to insure good electrical contact. The lower end of pin 280 extends through a hole (not shown) in the base plate 60 and in a hole (not shown) in backplane 50 and is bolted thereto. When thus mounted, the lower end of the body of part 275 is seated in an octagonal recess 63 in the top surface 61 of the base plate portion 60. This arrangement permits the two-part terminal 170 to be oriented in eight different positions and it insures that the two parts thereof are always keyed together properly so that only the appropriate connectors 30 and 40 may be mated. It is understood that, under some circumstances, it may be desirable for the terminal 170 to utilize other than an octagon shape.

The guide pin stub 190 is inserted in hole 110 in the upper plate 70 and in hole 140 in block 135 and is secured thereto to complete the assembly 10.

In assembling the parts described above, part 275 is bolted to mating backplane connector 40 and backplane 50 and part 175 is bolted to block 135 and thus to circuit board connector 30. Then the circuit board connector 30 is secured to mating backplane connector 40 with part 275 properly aligned with part 175. The upper end of pin 280 is inserted in the central bore of the part 175 to act as a guide for the assembly.

In this completed assembly, stub 160, stub 190 and pin 280 are available to have ground, power or signal coupled to them.

Accordingly, there has been described an arrangement for providing ground, power and signal connections in a connector, which arrangement also provides a keying function. While a preferred embodiment has been disclosed, it will be apparent to those skilled in the art that various modifications may be made and it is only intended that the scope of this invention be limited by the appended claims.

We claim

1. An electrical connector assembly for connecting a first circuit board to a second circuit board comprising:

a first insulated connector housing mounted to said first circuit board;

a second insulated connector housing mounted to said second circuit board;

a first projecting wall on said first connector housing having a lower surface with a first multi-faceted recess therein;

a second projecting wall on said second connector housing having an upper surface with a second multi-faceted recess therein, said second multi-faceted recess being aligned with said first multi-faceted recess when said first and second connector housings are secured one to the other; and a combination keyed and guided electrical connector terminal including:

a first part having a first body portion with a multi-faceted outer surface complemental to said first multi-faceted recess;

means for securing said first part to said first connector housing with said first body portion seated in said first recess;

said first body portion having a projection with a multi-faceted outer surface coextensive with only a portion of the outer surface of said first body portion and a first inner flat surface;

a second part including a second body portion having a multi-faceted outer surface coextensive with the remaining portion of the outer surface of said first body portion and a second inner flat surface;

means for securing said second part to said second connector housing with said second body portion seated in said second recess; and said first and second parts being adapted to be coupled together with said flat surfaces of said first and second body portions adjacent to each other and said first body portion projection seated in that part of said second recess not occupied by said second body portion, with the combination of said first and second body portions together forming a single body having a unitary multi-faceted outer surface along its entire length and completing an electrical connection path.

2. The assembly according to claim 1 wherein said connector terminal further includes a contact spring mounted on said first body portion adjacent said first inner flat surface.

3. The assembly according to claim 1 wherein said first body portion is formed with a central bore and said second part includes a guide pin adapted to extend into said central bore.

4. The assembly according to claim 1 wherein said multi-faceted recesses and said multi-faceted outer surfaces are octagonal.

* * * * *